United States Patent [19]

Amamoto et al.

[11] 4,155,194

[45] May 22, 1979

[54] TOY SPRING-TYPE PROJECTILE LAUNCHER HAVING DIRECTIONAL CONTROLLING JOY STICK

[75] Inventors: Kenneth I. Amamoto, Los Angeles; Ferenc Fekete, Huntington Beach; Wayne R. Halford, Manhattan Beach; Eugene J. Kilroy, Palos Verdes Estates, all of Calif.; Michael O. Hirtle, East Aurora, N.Y.

[73] Assignee: Mattel, Inc., Hawthorne, Calif.

[21] Appl. No.: 816,477

[22] Filed: Jul. 18, 1977

[51] Int. Cl.[2] ..... F41B 7/08; A63H 27/14

[52] U.S. Cl. ..... 46/81; 124/17; 124/35 R

[58] Field of Search ..... 124/17, 21, 22, 35 R, 124/41 R, 26, 25; 273/110, 129, 79; 46/81

[56] References Cited

U.S. PATENT DOCUMENTS

| | | | |
|---|---|---|---|
| 2,261,512 | 11/1941 | Dawson | 124/26 UX |
| 2,611,355 | 9/1952 | Ashwood | 124/41 R X |
| 2,804,619 | 8/1957 | Holt | 46/81 |
| 3,031,797 | 5/1962 | Gelfand | 124/26 X |
| 3,207,144 | 9/1965 | Soderman | 124/21 |
| 3,408,768 | 11/1968 | Glass et al. | 124/21 X |
| 3,496,671 | 2/1970 | Korona | 124/26 UX |
| 3,774,584 | 11/1973 | Paulson | 273/26 D X |

FOREIGN PATENT DOCUMENTS

| | | | |
|---|---|---|---|
| 554263 | 1/1957 | Italy | 124/17 |

*Primary Examiner*—Richard C. Pinkham
*Assistant Examiner*—William R. Browne
*Attorney, Agent, or Firm*—John G. Mesaros; Max E. Shirk; Ronald M. Goldman

[57] ABSTRACT

A toy launcher is provided for launching airplanes, missiles or the like, the launcher being provided with a base having a drum member pivotally mounted within the base, the periphery of the drum having a bearing for receiving the axis of a joy stick handle which is pivotally mounted with respect to the drum member. A gimbal mechanism within the drum is operatively connected to the handle and to a launch arm extending out from the drum, the launch arm containing a launch mechanism for releasably receiving airplanes or the like for launching the same in response to actuation of a trigger mechanism in the handle. Manipulation of the joy stick angularly displaces the surface of the launch arm to permit pre-positioning of the intended flight path and bank angle of the projectiles to a given attitude prior to launching.

12 Claims, 13 Drawing Figures

FIG. 5
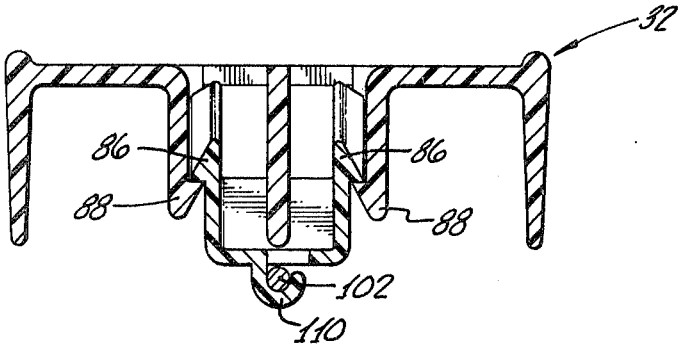
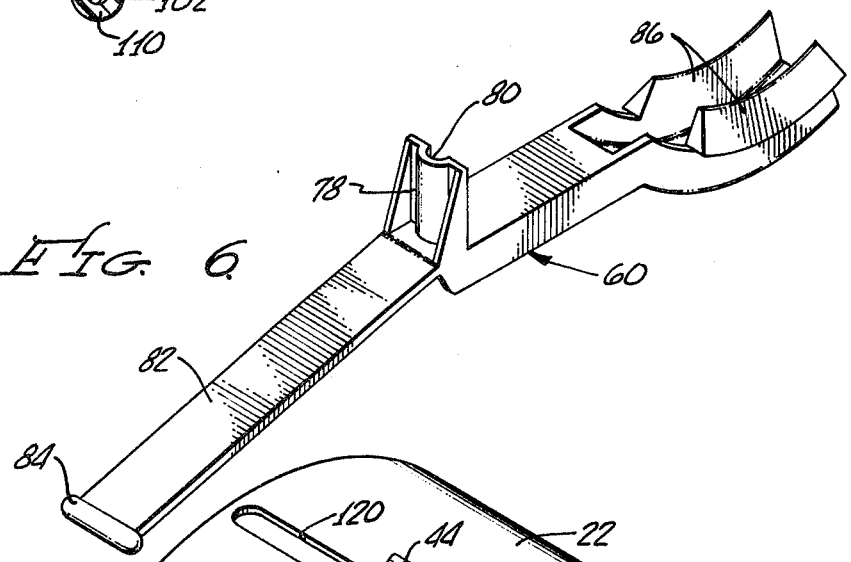
FIG. 6
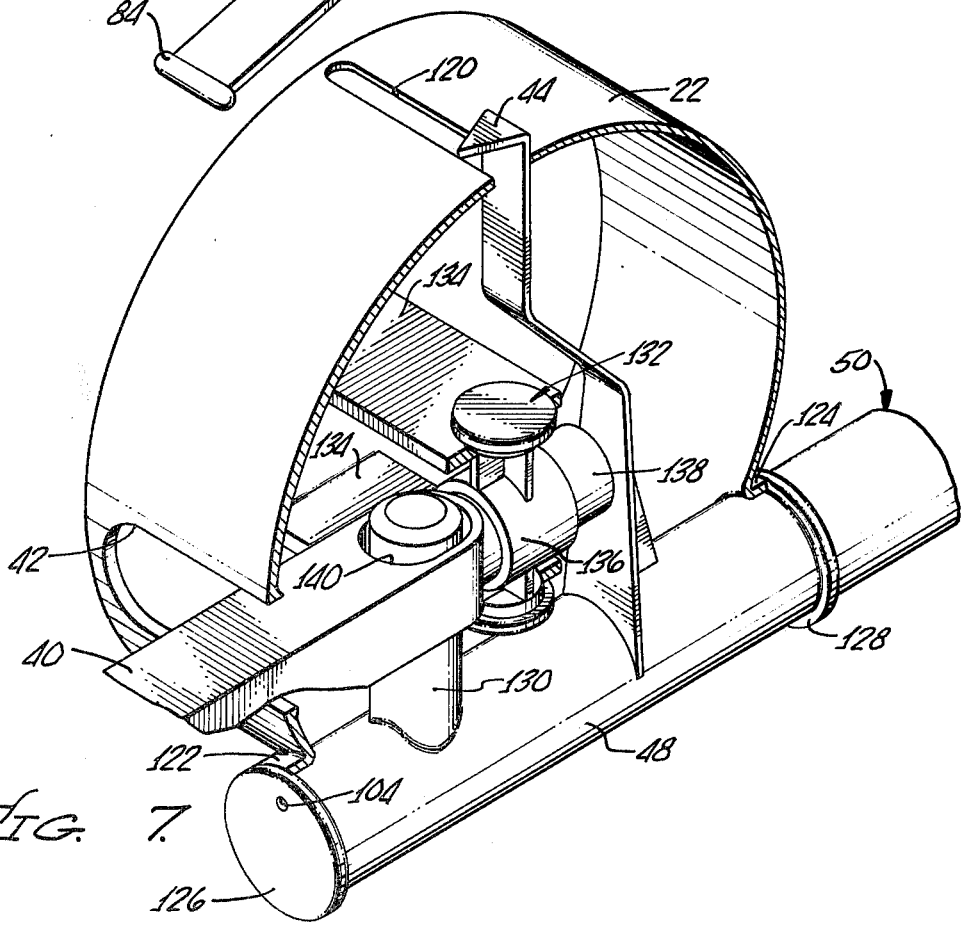
FIG. 7

FIG. 8.
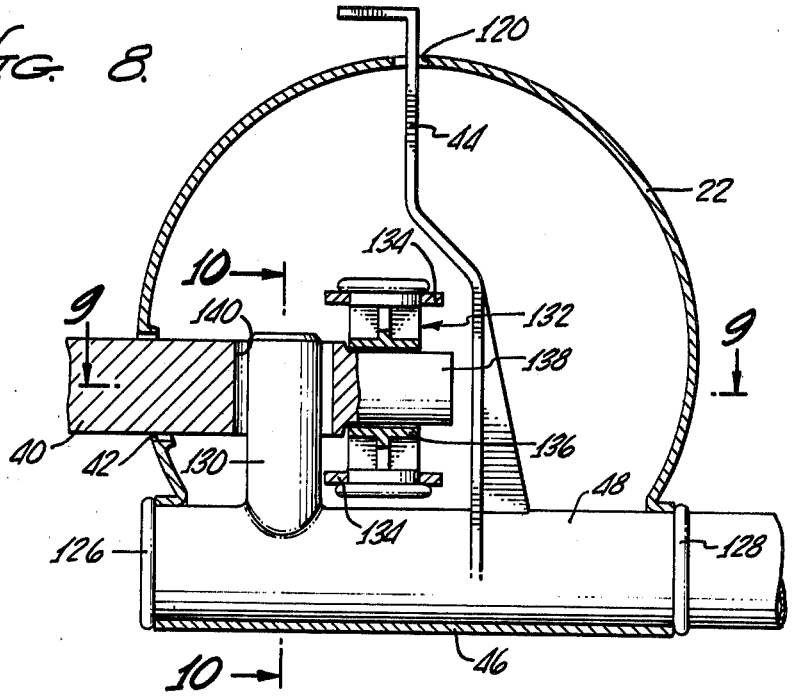
FIG. 9.
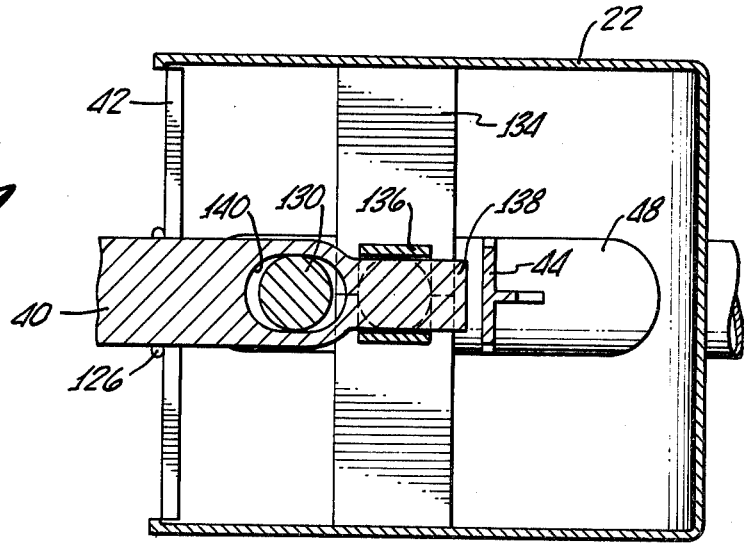
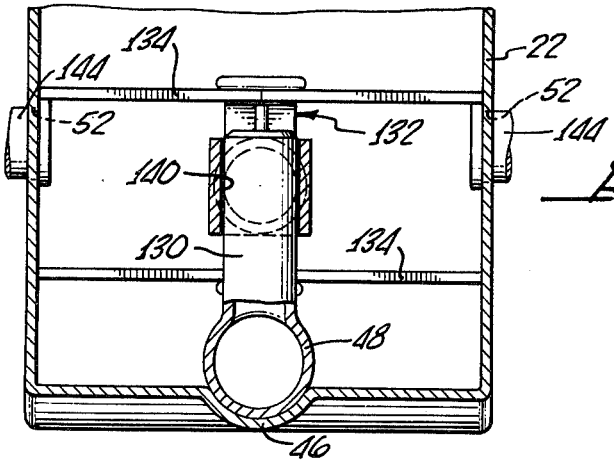
FIG. 10.

TOY SPRING-TYPE PROJECTILE LAUNCHER HAVING DIRECTIONAL CONTROLLING JOY STICK

CROSS-REFERENCE TO RELATED APPLICATIONS

This patent application is related to a co-pending U.S. patent application Ser. No. 727,885, U.S. Pat. No. 4,060,930, filed Sept. 29, 1976 entitled "TOY AIRPLANE LAUNCHER" by Michael Hirtle, et al., such patent application being assigned to Mattel, Inc., the assignee of the instant invention.

BACKGROUND OF THE INVENTION

The background of the invention will be set forth in two parts:

1. Field of the Invention

The present invention pertains generally to the field of toys and more particularly to a toy projectile launcher for launching two or more projectiles under the operation of a single trigger along a controllable flight path.

2. Description of the Prior Art

Launching devices for projectiles and more particularly for two or more airplanes are shown in U.S. Pat. Nos. 2,261,512 and 3,902,271. The first of the two references discloses a toy simulating an airplane carrier mounted on wheels, the toy being propelled by a spring-wound motor. As the toy moves under control of its motor, the motor operates cam members, one for each flight station to successively launch airplanes mounted thereon. In the latter reference, the airplanes are constructed with tubular members engaging rods on a hand-held launcher, the planes being released to operate under the force of coil springs upon actuation of a trigger.

Other toy airplane launchers are provided with means whereby the launch platform can be pivoted to a predetermined angle prior to release or launch of the airplane. Such launching devices are shown in U.S. Pat. Nos. 2,804,619 and 3,025,846, the structures of both of these patents having a single movable launch platform pivotable with respect to a stationary base member, the hinge forming the pivoting axis remaining at all times in a single plane.

Other prior art known to the applicant is listed in a separate communication to the Patent Office by way of illustration and not of limitation.

It is an object of the present invention to provide a toy projectile launcher having a joy stick control handle.

It is another object of this invention to provide a toy projectile launcher having a launch arm with the surface thereof controllable by the joy stick to launch the projectiles thereon at different angles of elevation with varying degrees of bank.

SUMMARY OF THE INVENTION

The foregoing and other objects of the invention are accomplished by providing a toy projectile launcher having a base adapted to be supported upon a surface. A generally hollow drum member is pivotally mounted within the base for pivoting about a first axis generally parallel to the surface. A handle in the form of a joy stick is pivotally secured to the periphery of the drum, the pivotal shaft portion of the handle having a generally perpendicular actuating rod extending into the interior of the drum. A gimbal bearing member is rotatably secured within the drum interior about an axis transverse to the first axis, the gimbal bearing member being in proximate spaced relation with the actuating rod. The gimbal bearing member is provided with a centrally disposed journal portion having an axis perpendicular to the axis of the bearing member. A launch arm is provided with a launch platform surface for receiving projectiles, such as airplanes thereon one end of the launch arm being provided with a shaft portion rotatably received within the journal portion of the gimbal bearing member, the launch arm also having an enlarged aperture through which the actuation rod extends. Trigger means are carried by the job stick to control a bowden cable for operating resilient launch means on the launch arm to release the projectiles. Movement of the joy stick through an angle about the first axis rotates the drum to displace the launch arm with respect to the first axis. Movement of the joy stick about its pivot axis angularly displaces the surface of the launch arm with respect to a horizontal surface and also with respect to a line extending through the pivot axis of the handle shaft. The attitude of the projectile is thus set prior to launch.

Other objects, features and advantages of the invention will become apparent upon a reading of the specification when taken in conjunction with the drawings in which like reference numerals refer to like elements in the several views.

BRIEF DESCRIPTION OF THE DRAWINGS

FIG. 5 is a cross-sectional view taken along line 5—5 of FIG. 4;

FIG. 6 is a perspective view of the launching member used in the toy projectile launcher;

FIG. 7 is an enlarged perspective view depicting the gimbal mechanism within the drum;

FIG. 8 is a cross-sectional side view of the gimbal mechanism shown in FIG. 7;

FIG. 9 is a cross-sectional view taken along line 9—9 of FIG. 8;

FIG. 10 is a cross-sectional view taken along 10—10 of FIG. 8;

DESCRIPTION OF THE PREFERRED EMBODIMENT

Figure 1:
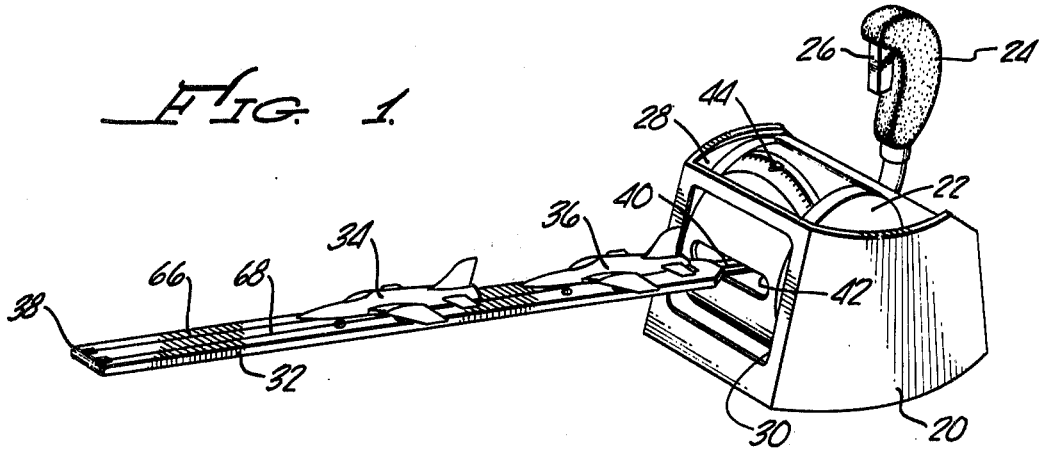
FIG. 1 is a perspective view of the joy stick-operated toy projectile launcher according to the invention.

Referring now to the drawings and particularly to FIG. 1 there is shown a projectile launcher which includes a base 20 adapted to be supported on a surface, preferably a horizontal surface such as a table, the floor or the like. The base 20 is generally a supporting shell having pivotally mounted therein a drum 22 which is pivotable about a horizontal axis, or an axis parallel to the surface supporting the housing 20. Supported by the drum 22 is a handle 24 with a trigger member 26 therein, the handle 24 and trigger 26 being configured to simulate a joy stick of an operational-type airplane. The upper portion 28 of the base is open and the front surface of base 20 is provided with a rectangular opening 30. Extending outwardly from and supported by the drum 22 is a launch platform or arm 32 adapted to support in tandem relation toy airplanes 34 and 36, respectively. The launch arm 32 is generally elongate in form and has a free end 38 and a reduced cross section end 40, which extends through an elongate generally horizontal slot 42 formed in the periphery of drum 22. Positioned on the upper surface of drum 22 is an angle indicator 44 which operates in conjunction with the position of handle 24.

Briefly, the toy airplane launcher operates as follows. Each of the toy airplanes 34 and 36 is positioned on the launch arm 32 with suitable launching means such as elastic bands extending over the free end 38 to be releasably secured to a portion of the underside of each of the toy airplanes. As will hereinafter be discussed, the launch arm 32 is provided with launching means coacting with each of the airplanes 34 and 36, the launching means being operable by depression of the trigger 26 of the handle 24 by an operator or child grasping the handle 24. Prior to depression of the trigger 26, the operator has the flexibility of rotating the drum 22 about its axis to a desired angle of elevation. The reduced cross section end 40 of the launch arm 32 is suitably supported within the drum 22 by gimbal means. The handle 24 is pivotable about an axis generally perpendicular to the axis of the drum 22, the pivoting shaft of the handle 24 having a portion thereof operatively coupled and forming a part of the gimbal means to control the angular position of the launch arm 32 with respect to a line parallel to the axis of the pivoting shaft, the line so-formed extending generally through the longitudinal axis of the launch arm 32 in its neutral or central position. The gimbal means also angularly displace the surface of the launch arm 32 with respect to the horizontal surface supporting the base 20 thereby enabling the airplanes 34 and 36 to have the launch surface thereof pre-positioned with respect to three mutually perpendicular axes. In the neutral position with the joy stick controller or handle 24 perpendicular to the axis of drum 22, the launch arm 32 is centrally disposed with respect to the slot 42 and viewing an end cross section through the free end 38, the cross section so-formed is parallel to the surface on which the base 20 is supported. By the operator pulling the handle 24 rearwardly or clockwise as viewed in FIG. 1, the drum 22 is rotated about its axis and so long as the handle 24 is maintained perpendicular to the pivot axis of drum 22, the horizontal alignment between the end section of launch arm 32 and the horizontal surface is maintained. This movement or rotation of drum 22 elevates the plane of the launch arm 32 to some angle with respect to the horizontal surface supporting the base 20 but the launch arm 32 is still in its central or neutral position. If, at this point, the toy airplanes 34 and 36 are launched, they will be launched at a predetermined climb angle with no bank, that is, a line extending through opposite wing tips will be parallel to the surface supporting the base 20.

If, after the predetermined climb angle is established by the user, the joy stick or handle 24 is pivoted about its pivot shaft the gimbal means within the drum 22 will cause two discrete angular displacements. The longitudinal axis extending through the center line of launch arm 32 will be displaced with respect to a line defined by the longitudinal axis of the launch arm 32 in its neutral position. This displacement will occur in general alignment with the long axis of slot 42. Additionally, the surface of the launch arm 32, again viewing an end cross section, will be displaced or dipped relative to the horizontal surface supporting base 20 thereby providing a bank angle, this combination of bank angle and deviation from the central or neutral position being indicated by the angle indicator 44. Thus, the operator is provided with numerous initial positions of the launch arm 32 with respect to the bottom of base 20 to which the airplanes can be pre-positioned prior to launch to create various "attack" launching situations simulating aerial maneuvers. As will also hereinafter be discussed, the airplanes 34 and 36 are launched sequentially with the lead airplane 34 being launched first with a time differential prior to the launching of the second toy airplane 36, the time differenital between launchings being dependant upon the speed with which trigger 26 is operated.

Referring now to FIGS. 2–6, the details pertaining to the launching mechanism will be discussed.

Figure 2:
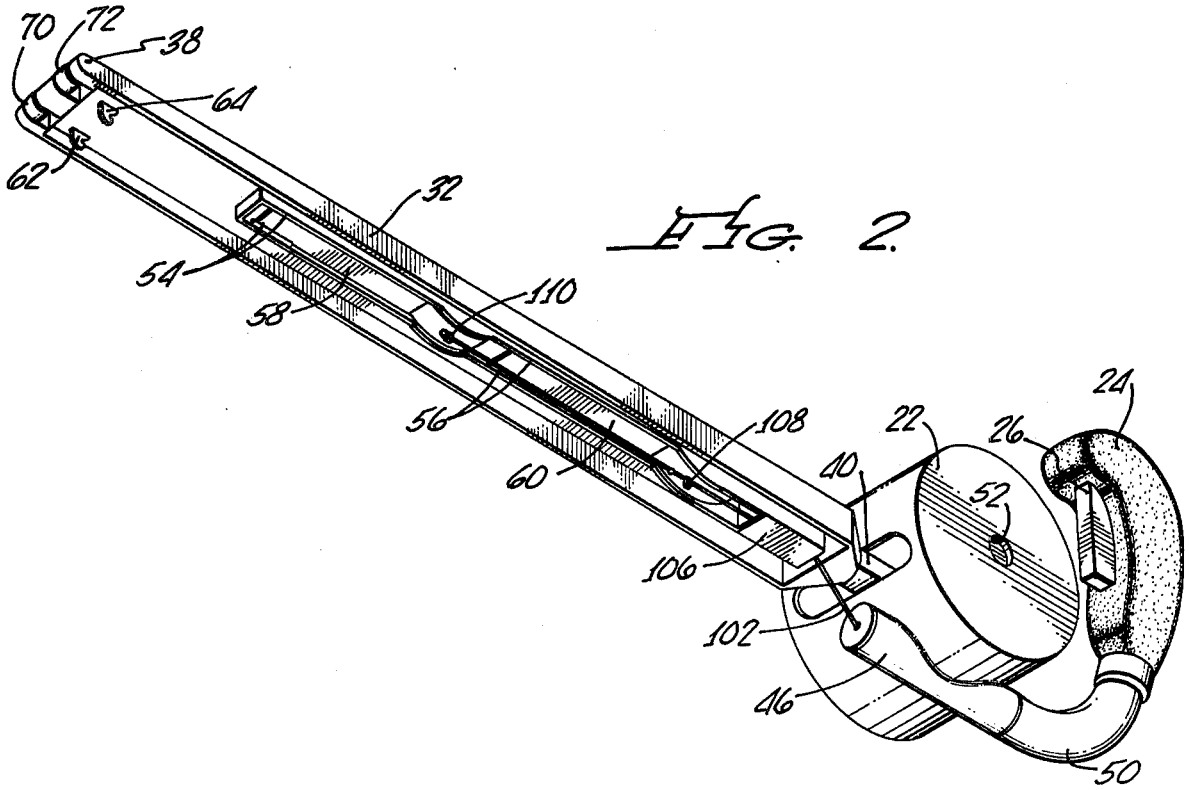
FIG. 2 is a perspective view of the underside of the toy projectile launcher with the base removed.
Figure 3:
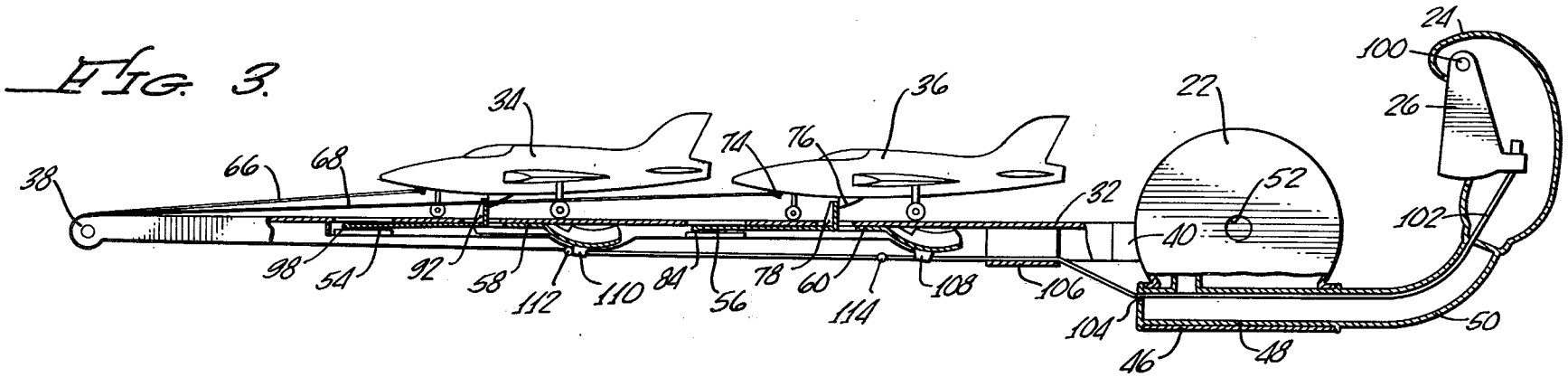
FIG. 3 is a partial cross-sectional view of the launcher apparatus shown in FIG. 2 with toy airplanes mounted thereon.

As shown in FIG. 2, the drum 22 has been removed from the base 20 and on the undersurface of drum 22 there is formed integrally therewith in the periphery thereof a journal portion 46 which receives the pivot shaft 48 of the handle 24 (See also FIG. 3). The handle 24 is generally hollow and is coupled at the lower end thereof to a hollow tubular member 50 having a straight portion thereof forming the pivot shaft 48, the overall configuration of the tubular member 50 and the handle 24 being generally L-shaped with the handle 24 extending generally perpendicular to the pivot shaft 48. The drum 22 is provided with aligned apertures 52 (only one of which is shown), the aperture 52 defining the central axis of the cylinder or drum 22 and having inserted therein suitable projections formed on the interior surface of base 20 for pivotally supporting the drum 22.

The launch arm 32 has a generally planar surface and is elongated and generally bar-shaped with the undersurface thereof configured to form integral trackways 54 and 56, respectively, each of the trackways partially accepting a portion of launching members 58 and 60, respectively. At the forward end 38 of the undersurface of the launch arm 32 there is provided a pair of integral hook members 62 and 64, each being adapted for having looped thereover an elastic band 66 and 68, respectively. The elastic bands are looped over pulleys 70 and 72, respectively, to minimize friction, the pulleys 70 and 72 being rotatably secured along the same axis to the front end 38 of launch arm 32. As better illustrated in FIG. 4, the fuselage of the airplane 36 is provided with a first downwardly extending projection 74 beneath the nose thereof for receiving the loop of the elastic band 68. Beneath the cockpit of the undersurface of the fuselage of the airplane 36 a second downwardly extending projection 76 is secured, the projection 76 being adapted to coact with an upwardly extending abutment 78 formed integrally with the launching member 60, the abutment 78 being adapted to releasably receive the airplane 36 by means of the projection 76 being in engagement with abutment 78 with the elastic band 68 under tension. Thus, the airplane 36, and similarly the airplane 34 are loaded onto the launch arm 32 for subsequent launching.

Figure 4:
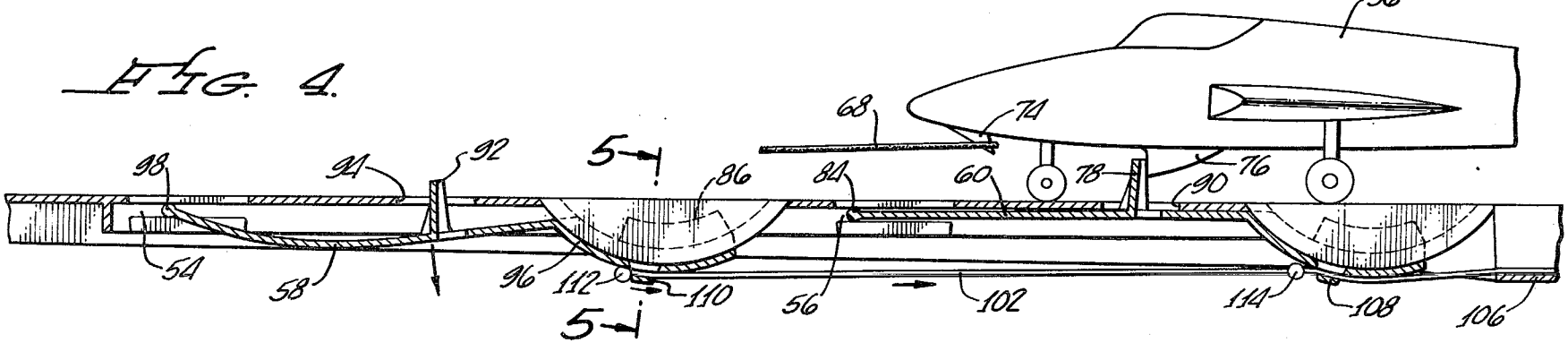
FIG. 4 is an enlarged cross-sectional view of a portion of the apparatus depicted in FIG. 3.

As illustrated in FIG. 6, the launching member generally designated 60 is generally elongate with the abutment 78 perpendicular to the main body thereof and having a vertically extending recess 80 formed therein to receive the matingly configured downwardly extending projection 76 on airplane 36. To the left of the abutment 78 as viewed in FIG. 6, a generally bar-shaped resilient tongue 82 is formed terminating in a transversely extending rod portion 84 which has an overall dimension wider than the cross-sectional dimension of tongue 82, the projecting ends of rod portion 84 being adapted to be received in the trackway 56 formed in the undersurface of launch arm 32. Extending in general alignment therewith in the opposite direction, the launching member 60 has a main body portion which is generally rigid and terminates in an arcuately configured bearing segment 86, the bearing 86 being configured to be slidably received within arcuately formed bearing tracks formed in the undersurface of launch arm 32 (See FIG. 5). During assembly, the rod portion 84 is inserted within the trackways 56 and then the bearing segment 86 of launching member 60 is snapped into the bearing tracks 88 with abutment 78 extending through aperture 90 formed in the "runway" of the launch arm 32 (See FIG. 4). As shown in FIG. 6, the plane of tongue 82 is offset downwardly from the main plane of the body portion of launch member 60 and with the launching member 60 assembled as shown in FIG. 4, the tongue 82 biases the abutment 78 upwardly through aperture 90 to provide a normal upwardly biased force. Similarly, the launching member 58 is identically configured with the abutment 92 thereof extending upwardly through an aperture 94, the launching member 58 being illustrated in its operative position, that is, with the bearing segment 96 thereof rotated in a counterclockwise direction as indicated by the arrow adjacent thereto to downwardly displace the abutments 92 with respect to the plane of the aperture 94. During this maneuver the rod portion 98 is guided within trackway 54 with the tongue of launching member 58 being deflected downwardly against the force of its inherent bias.

As better illustrated in FIGS. 3 and 4, the trigger member 26 is generally fan-shaped and is pivotally coupled at the apex 100 thereof within the housing of handle 24, the other end of trigger 26 having secured thereto one end of a cable 102 which passes through the tubular member 50 out through an aperture 104 in the end thereof through a guide 106 formed on the undersurface of launch arm 32 adjacent the reduced cross section end 40. The cable 102 then passes through a first eyelet 108 formed on the undersurface of bearing segment 86 of launching member 60 and then through a second eyelet 110 formed on the undersurface of the bearing segment 96 of launching member 58. The Bowden cable 102 is then pulled taut with the launching members 58 and 60 in the position shown in FIG. 3 and a first clamp 112 is applied to the free end of cable 102 adjacent and in close proximate contact with eyelet 110. A second clamp 114 is affixed to the cable 102 at a position spaced from eyelet 108, the clamps 112 and 114 contacting the leading edges of eyelets 110 and 108, respectively, to suitably rotate or pivot the launch members 58 and 60, respectively, only after contact of the clamp with the eyelet is effected by depressing trigger 26.

In launching the toy airplanes 34 and 36 under force of the elastic bands 66 and 68, respectively, launching occurs when the abutments 92 and 78 are displaced along a line generally perpendicular to the plane of the launch arm 32, this displacement occurring when the respective launch members are pivoted. As the trigger 26 is depressed, the cable 102 is displaced upwardly within handle 24 resulting in the condition shown in FIG. 4. That is, the lead launching member 58 is pivoted against the force of its tongue until the upper edge of abutment 92 clears the downwardly depending projection on the undersurface of toy airplane 34 thus permitting airplane 34 to be launched under the force of the elastic band 66. At this time, with the Bowden cable 102 being moved to the right as indicated by the arrow adjacent thereto, the clamp 114 on cable 102 is approaching contact with eyelet 108. At the point when contact between clamp 114 is made with eyelet 108, launch member 60 is then pivoted or rotated about its bearing segment 86 thereby displacing abutment 78 downwardly until it clears downwardly depending projection 76 on the under belly of toy airplane 36 thus permitting the airplane to be launched under the force of its elastic band 68. As a result, if the trigger 26 is pivoted inwardly within handle 24 slowly, the lead airplane 34 can be launched while retaining airplane 36 on the launch arm 32 if the trigger 36 is not depressed any further. If the trigger 26 is depressed in a uniform fashion to its maximum position, the lead airplane 34 will be released with a time differential prior to release of the toy airplane 36, this time differential being determined by the speed of movement of trigger 26 and the mechanical spacing of clamp 114 with respect to eyelet 108. The time differential between sequential releases is inversely proportional to the speed of pivoting of trigger 26, thus providing additional variables in the play situation with respect to a pursuit or attack setting involving both toy airplanes.

Referring now to FIGS. 7–13, the details pertaining to the gimbal mechanism will be discussed. As best illustrated in FIGS. 7 and 8, the drum 22 is cylindrical and hollow and provides a mechanism housing to support the launch arm 32 and the operatively connected components for controlling the launch arm 32. The drum 22 has configured in the periphery thereof the bearing journal 46 which receives the pivot shaft 48 therein, the journal 46 being generally open on the interior of drum 22 with the terminal ends 122 and 124 of journal 46 terminating exteriorally of the drum 22 to form bearing apertures through which the pivot shaft 48 extends. The pivot shaft 48 has affixed thereto shoulder means 126 and 128 to maintain the positional relation of pivot shaft 48 within the journal 46. Formed integral with pivot shaft 48 and extending perpendicularly thereto, is an actuating rod 130, the actuating rod 130 being in a direction parallel to the handle 24. Extending upwardly and rearwardly of actuation rod 130 is a pointer or angle indicator member 44 which is formed integrally with the pivot shaft 48 for suitably secured thereto, the indicator 44 being generally web-shaped and slightly offset within the interior of drum 22 to provide suitable clearance for other components therein, the free end of indicator 44 being a pointer adapted for movement within a slot 120 formed in the surface of drum 22. The slot 120 is on a line parallel to the axis of rotation of drum 22 and parallel to the slot 42 formed in the surface of drum 22.

The mechanism illustrated in FIGS, 7–10 show the positional relationship of the various components with the launch arm 32 at its neutral or central position, that is, with the longitudinal axis of launch arm 32 being perpendicular to the plane of slot 42, and the relationship of the components therein will now be described with reference to this neutral position although it is to be understood that the positional relationship will vary as the joy stick or handle 24 is suitably manipulated. In any event, parallel to and rearwardly of actuating rod 130, there is a gimbal bearing member 132 which is rotatably received in bearing members 134 formed on the interior of drum 22. The bearing members 134 are spaced web portions having apertures therein receiving gimbal bearing member 132 pivotally or rotatably along a pivot axis parallel to the neutral position of actuating rod 130, the axis of gimbal bearing member 132 being perpendicular to the axis of rotation of drum member 22. The central portion 136 of bearing member 132 is provided with an enlarged circular aperture or journal which is open on both ends, the axis of journal 136 being perpendicular to the axis of pivoting of gimbal bearing member 132. The journal 136 receives therein in close mating relation a shaft projection 138 which is formed in one end of launch arm 132, the center of shaft projection 138 defining the longitudinal axis of launch arm 32 about which pivoting takes place. Forwardly of the shaft portion or projection 138, the reduced cross section end 40 of launch arm 32 is provided with an enlarged aperture 140 which extends generally perpendicular to the launching surface and loosely receives therein the free end of actuating rod 130.

As can be seen from FIGS. 7–10, the launch arm 32 is capable of being displaced angularly about 3 axes disposed in three mutually perpendicular directions. As shown in FIG. 10, the apertures 52 of the mechanism housing or drum 22 engage inwardly extending projections 144 formed within the interior of opposite sides of base 20, the projections 144 defining a first axis about which the drum member 22 is pivoted to displace the launch arm 32 angularly with respect to the surface on which the base 20 rests. By viture of the axis of the gimbal bearing member 132 having the journal portion 136 thereof supporting the rearward shaft portion 138 of the launch arm 32, the launch arm 32 can be displaced angularly about this axis of the bearing member 132 within slot 42, the angular displacement occurring with respect to a line parallel to a line drawn through the center of the pivot axis of shaft 48. With the actuating rod 130 of the handle means positioned forwardly of the axis of gimbal bearing member 132, the movement of the actuating rod 130 within the slot 140 of the launch arm 32 pivots the surface of the launch arm 32 about the longitudinal axis thereof, this axis extending through the center of journal portion 136 of the gimbal bearing member 132.

FIGS. 7–10 all illustrate the position of the longitudinal axis of the launch arm 32 at its null or central position, this being the position when a line extending through the center of actuating rod 130 is exactly parallel to the axis extending through the center of gimbal bearing member 132 resulting in the longitudinal axis of launch arm 32 being perpendicular to the rotational axis of drum 22 defined by projections 144. Additionally, this longitudinal axis is at the mid-point within slot 42 and the surface of launch arm 32 flies in a plane parallel to the axis of rotation of the drum 22 defined by a line extending through the projections 144. As illustrated in FIGS. 7, 8 and 9, the slot 140 within the reduced diameter section 40 of the launch arm 32 is elongate in form with the elongation extending along the longitudinal axis of the launch arm 32. The actuating rod 130 is positioned within the slot 140 with the edges thereof perpendicular to the longitudinal axis of the launch arm 32 closely abutting the sides of the slot 140 (see also FIG. 10).

Figure 11:
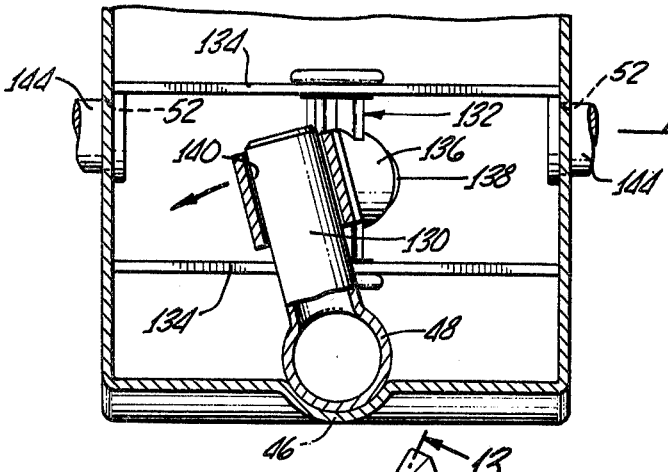
FIG. 11 is a view similar to the view of FIG. 10 with the actuating rod of the handle angularly displaced.
Figure 12:
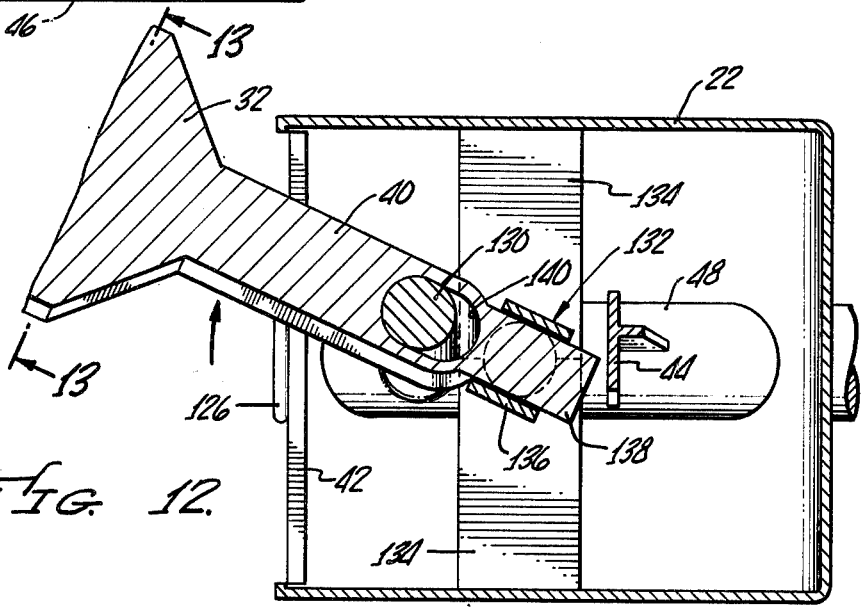
FIG. 12 is a cross-sectional plan view depicting the launch arm position with the actuating rod in the position shown in FIG. 11.
Figure 13:
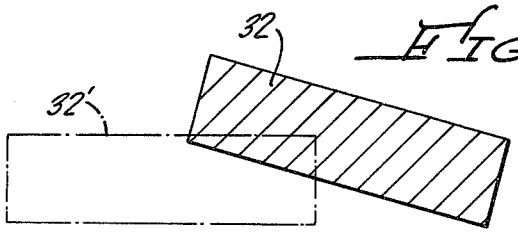
FIG. 13 is an end view of the launch arm taken generally along line 13—13 of FIG. 12 diagramatically illustrating the angular displacement of the surface of the launch arm with respect to its central or horizontal position.

FIGS. 11–13 illustrate the "banking" of the surface of the launch arm 32 when, as viewed from the operator's side of the drum 22, the handle 24 is rotated in a clockwise direction. All references hereafter to right and left will be from the operator's vantage point. FIG. 11 is a view similar to FIG. 10, that is, looking from the launch arm end of the assembly with the operator rotating the handle 24 clockwise resulting in the same angular displacement of the actuating rod 130 to thereby generate a compound movement of the launch arm 32. Initially, due to the restraint imposed on the longitudinal axis by means of the shaft portion 138 of the launch arm 32 within the journal portion 136 of the gimbal bearing member 132, the surface of the launch arm 32 is rotated about its longitudinal axis, and additionally being angularly displaced from its "null" or neutral position to the right as viewed in FIG. 12. Since the actuating rod 130 is pivoting in a fixed plane, as can be seen in FIG. 12, the position of the actuating rod 130 within the slot 140 is displaced forwardly to accomodate this rotation. As viewed in FIG. 13, the rectangle 32' in broken lines depicts the neutral of null position of the launch arm 32 with the cross-hatched rectangle 32 illustrating the angular displacement or banking of the surface of launch arm 32 as viewed by the operator. As also illustrated in FIG. 12, the pivoting of the longitudinal axis of launch arm 32 from its neutral position is about a line extending through the axis of rotation or pivoting of the gimbal bearing member 132 with the tilting of the surface or banking of the surface being accomplished along a mutually perpendicular line extending through the center of the journal portion 136 of the gimbal bearing member 132.

Correspondingly, if the handle 24 is rotated counterclockwise as viewed by the operator, the angle of bank or tilting of the surface of launch arm 32 will be to the left or counterclockwise and the angle of pivoting of the longitudinal axis will likewise be to the left thus simulating a predictable controllable operation similar to that of a job stick.

Consequently, a child utilizing the toy can rotate the drum member 22 within the base 20 about a first axis defined by projections 144, and then suitably rotate the handle 24 to some angle indicated by the pointer or indicator 44 within the slot 120 to pivotally displace the launch arm 32 to either side of the neutral position and simultaneously tilt or bank the surface of launch arm 32 through an angle determined by the relative dimensions of the parts and particularly the distance between the center of actuating rod 130 and the axis of gimbal bearing member 132. By this action, the launch surface can be oriented and then the airplanes 34 and 36 thereon can be sequentially or almost simultaneously launched by depression of the trigger 26 in a speed of movement consistent with the desired launch pattern to provide different flight paths for the airplanes according to the initial settings. With the toy airplane launcher shown and described the attitude of the airplanes to be launched can be pre-set to a climb angle, bank angle and a flight direction by manipulation of the joy stick control means or handle. Although the launch apparatus herein has been shown and described in conjunction with toy airplanes, various other projectiles, such as missiles or winged figures can be launched with the mechanism and the foregoing description is not intended to be limited to the use of airplanes as projectiles. While there has been shown and described a preferred embodiment, it is to be understood that various other adaptations and modifications can be made within the spirit and scope of the invention.

What is claimed is:

1. In a launcher for launching one or more toy projectiles, the combination comprising:

a base adapted for positioning on a supporting surface;

a generally hollow drum member pivotally supported by said base for rotation about a first axis generally parallel to the supporting surface;

a launch arm having a longitudinal axis and having a launch surface for supporting at least one toy projectile;

means on said launch arm for launching a toy projectile;

means operatively connecting one end of said launch arm to said member for angularly displacing the longitudinal axis of said launch arm with respect to said first axis and for angularly positioning the launch surface of said launch arm with respect to the supporting surface;

handle means pivotally coupled to the periphery of said drum member about a pivot axis generally transverse to said first axis, said handle means being coupled to said means operatively connected to said launch arm for pre-positioning said launch surface with respect to the supporting surface; and trigger means on said handle means for actuating said launching means.

2. The combination according to claim 1 further including toy airplanes and the launch surface of said launch arm is generally elongate and configured for supporting two toy airplanes in tandem relation.

3. The combination according to claim 1 wherein said means within said hollow member operatively connected to said launch arm includes gimbal means.

4. The combination according to claim 3 wherein said handle means includes a shaft portion pivotally supported by said drum and said gimbal means includes a gimbal bearing member pivotally coupled within said drum for movement about an axis perpendicular to said first axis and to the pivot axis of said shaft portion.

5. The combination according to claim 4 wherein the gimbal bearing member has an opening therein transverse to the axis thereof for receiving a bearing portion at said one end of said launch arm.

6. The combination according to claim 5 wherein said shaft portion has an actuating rod perpendicular thereto and said launch arm has an elongate aperture therein for receiving the free end of said actuating rod.

7. In a launcher for launching one or more toy projectiles, the combination comprising:

a base adapted for positioning on supporting surface;

a member pivotally mounted on said base;

handle means pivotally coupled to said member, movement of said handle means relative to said base pivoting said member;

a launch arm having a longitudinal axis and having a generally planar launch surface for supporting at least one toy projectile; and means operatively interconnecting one end of said launch arm to said member and to said handle means, said interconnecting means being responsive to pivotal movement of said handle means relative to said member for both angularly displacing the plane of the launching surface with respect to the supporting surface and for angularly displacing the longitudinal axis of said launch arm with respect to said base, the combined pivoting of said handle means and of said member establishing a predetermined launch attitude for a projectile.

8. The combination according to claim 7 wherein said interconnecting means includes a gimbal bearing member pivotally mounted within said member and having a journal portion, and said one end of said launch arm has a shaft projection extending into said journal portion.

9. The combination according to claim 8 wherein said member is a hollow drum member and said handle means includes a handle having a shaft portion pivotally secured adjacent the periphery of said drum member.

10. The combination according to claim 9 wherein said launch arm includes means for launching a projectile and said handle means includes trigger means for actuating said launching means.

11. In a launcher for launching one or more toy airplanes, the combination comprising:

a base adapted for positioning on a supporting surface;

a member supported by said base for pivotal movement about an axis generally parallel to the supporting surface;

a generally elongate launch arm having a longitudinal axis and having a generally planar launch surface for supporting at least one toy airplane, said launch arm having a first end with a shaft projection at the terminal end thereof and an elongate slot adjacent thereto;

a bearing member coupled within said member for pivoting about an axis generally perpendicular to the pivot axis of said member, said bearing member having a journal position for receiving said shaft projection;

handle means pivotally coupled to said member, said handle means having an actuating rod portion extending into said elongate slot, movement of said handle means toward or away from the supporting surface pivoting said member for establishing a launch angle, and pivoting of said handle means both pivoting said launch arm about its longitudinal axis and angularly displacing the longitudinal axis of said launch arm in the direction of pivoting of said handle means for establishing a predetermined bank angle and flight path for the toy airplane.

12. The combination according to claim 11 wherein said launch arm includes means for launching a toy airplane and said handle means includes trigger means for actuating said launching means.

* * * * *